United States Patent [19]

Cope

[11] Patent Number: 4,458,604

[45] Date of Patent: Jul. 10, 1984

[54] RADIAL RAILWAY TRUCK

[75] Inventor: Geoffrey W. Cope, Williamsville, N.Y.

[73] Assignee: Dresser Industries, Inc., Dallas, Tex.

[21] Appl. No.: 907,460

[22] Filed: May 19, 1978

[51] Int. Cl.[3] ..... B61F 3/08; B61F 5/26; B61F 5/38; B61F 5/50

[52] U.S. Cl. ..... 105/168; 105/182 R; 105/197 DB; 105/224.1; 105/226

[58] Field of Search ..... 105/167, 168, 169, 176, 105/182 R, 199 R, 199 C, 200, 224.1, 197 DB, 105/226; 308/137, 136

[56] References Cited

U.S. PATENT DOCUMENTS

| | | | |
|---|---|---|---|
| 243,797 | 7/1881 | Robinson | 105/168 |
| 956,900 | 3/1910 | Knobbs | 105/168 |
| 1,772,928 | 8/1930 | Kijlstra | 105/168 X |
| 2,296,106 | 9/1942 | Holland | 105/167 |
| 3,528,374 | 9/1970 | Wickens | 105/182 R |
| 3,789,770 | 2/1974 | List | 105/176 X |
| 4,003,316 | 1/1977 | Monselle | 105/182 R X |
| 4,067,261 | 1/1978 | Scheffel | 105/182 R X |
| 4,131,069 | 12/1979 | List | 105/176 X |

FOREIGN PATENT DOCUMENTS

| | | | |
|---|---|---|---|
| 1018404 | 10/1977 | Canada | 105/168 |

*Primary Examiner*—Howard Beltran
*Attorney, Agent, or Firm*—Barry E. Deutsch

[57] ABSTRACT

A self-steering radial truck having steering arms with side arms, the side arms being contoured and located so that they provide visual and physical access to the trucks brake beam head and brake shoe, place said cross beam at a position clear of the brake beam and car body members and position the connecting post at a preferred location to prevent interference with one of the standard bolster brake rod openings for interconnection with the mating steering arm by a metal male member on one connecting post member slidably engaging a recess in the other connecting post member with metal to metal contact and means to provide for angling articulation of the two arms and the associated wheelsets.

8 Claims, 13 Drawing Figures

RADIAL RAILWAY TRUCK

TECHNICAL FIELD

The technical field of this invention is railway car rolling stock. It particularly relates to railway car trucks which are self-steering radially.

BACKGROUND OF THE INVENTION

Several steered and so-called radial trucks have been developed utilizing various means of inducing the wheels and axles of a railroad freight car truck or passenger truck to assume a radial position when entering and negotiating curved track and of controlling the lateral stability of the wheelsets at high speeds on straight (tangent) track. All required major changes from the conventional side frame and bolster, and most failed to provide the necessary high speed tracking (or hunting) control. In addition, the steering means in most cases prevented observation of some vital parts of the truck, such as the brake shoes, and interfered physically with the servicing of these important components.

A further problem with prior art steering arm construction was in the considerable difficulty of assembly and disassembly of either the truck parts, steering components or both, to the extent that the concept has faced much resistance from the industry.

The List radial truck construction as shown in U.S. Pat. No. 3,789,770 and modified, has been proved by tests to be capable of providing the slow speed curving ability and high speed stability desired.

A major consideration is that the standard railroad truck has been many years in the development and proved to be a very reliable unit for the very severe environment that constitutes general railroad operation, and much technical background, testing and fatigue evaluation has been developed. The instabilities and poor curving symptoms that currently plague the unit were brought about by relatively recent increases in operating speeds and car size, high mileage, the elimination of spring planks and on the high capacity cars, the adoption of roller bearings which do not provide the freedom to accommodate the lateral deviations of the car or track, and consequently transmit the disturbances to the truck to initiate periodic oscillations of vibration called hunting.

To completely change the basic three-piece truck obviously would be a major step both from the technical and economic standpoint and probably prohibitive for the industry.

Accordingly, the primary object of the instant invention is to provide a steering arm construction that can be retrofitted to the standard truck to provide the proven advantages of radial steering and high speed lateral control without the necessity of making changes to the side frames or bolster.

A further object is to provide steering equipment that does not interfere with the foundation brake rigging, obscure the brake shoes from inspection, or complicate the brake maintenance procedures.

A still further object is to provide steering arms compatible with the conventional truck in that the assembly and disassembly of the truck components is not hampered.

Another object is to provide the steering function using a simple steering arm construction that, fail safe in the event of a mishap, i.e., will not negate the basic three-piece truck integrity.

Still another object is to provide steering arms that will allow ample flexibility of the truck to negotiate spiral track and maximum warped track without restriction.

Yet another object is to provide steering arms that utilize the existing space envelope within the conventional truck side frame and bolster assembly.

DETAILED DESCRIPTION OF THE EMBODIMENT

Other features of the invention will become apparent from the detailed description and the accompanying drawings in which.

Figure 1:
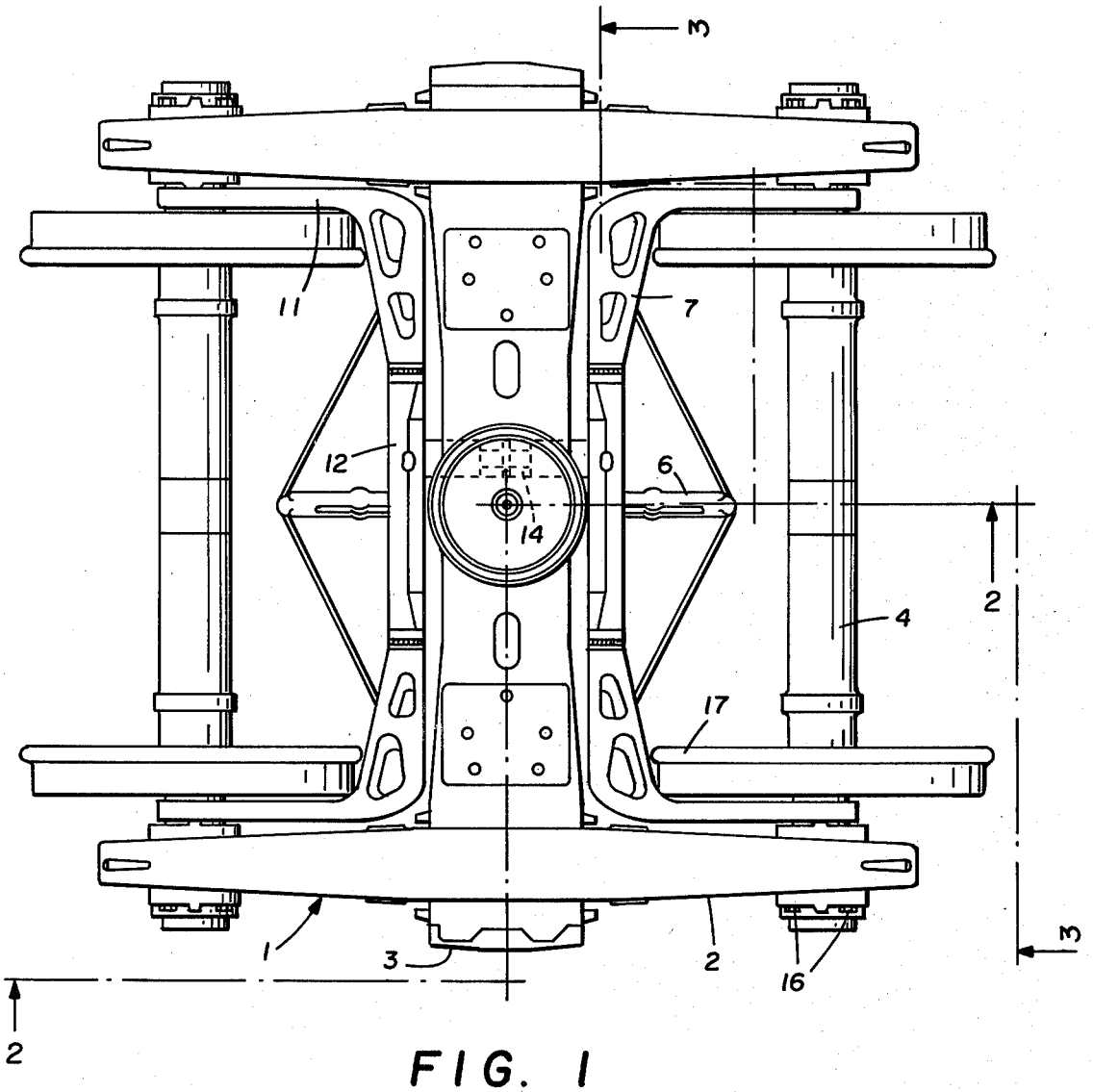
FIG. 1 is a plan view of a conventional freight car truck equipped with steering arms constructed according to the present invention.
Figure 2:
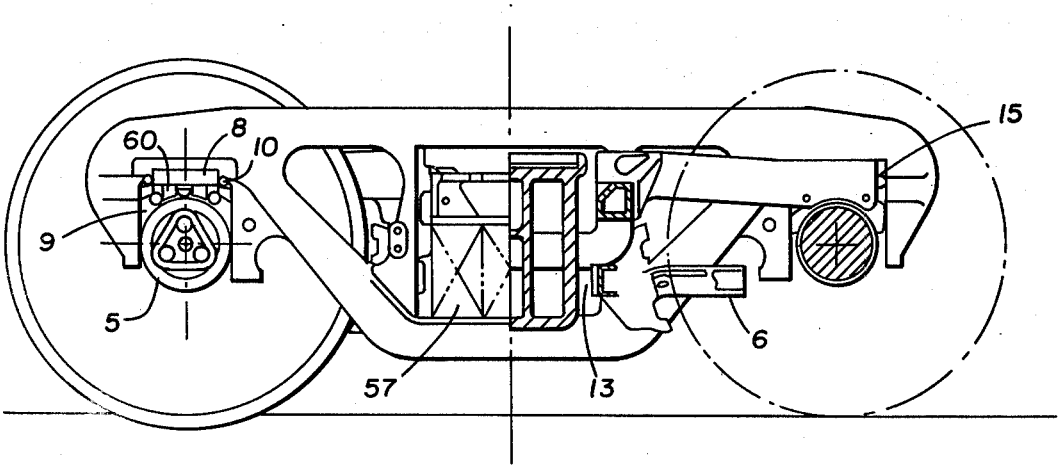
FIG. 2 is a fragmentary side elevation of the truck of FIG. 1.
Figure 3:
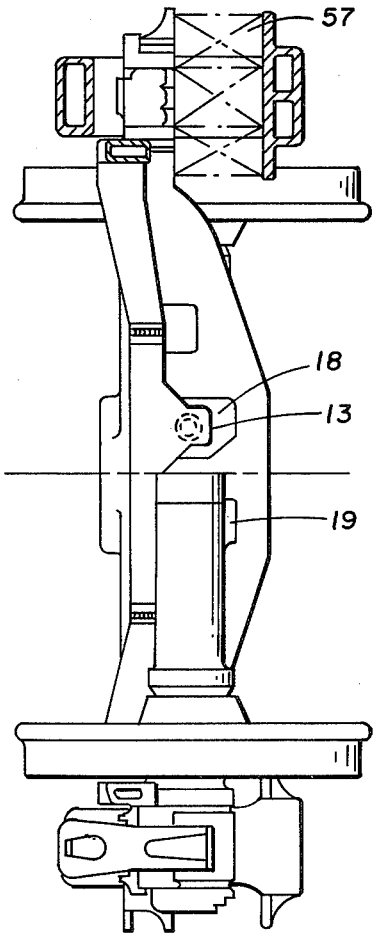
FIG. 3 is a fragmentary end view of the truck of FIG. 1.
Figure 6:
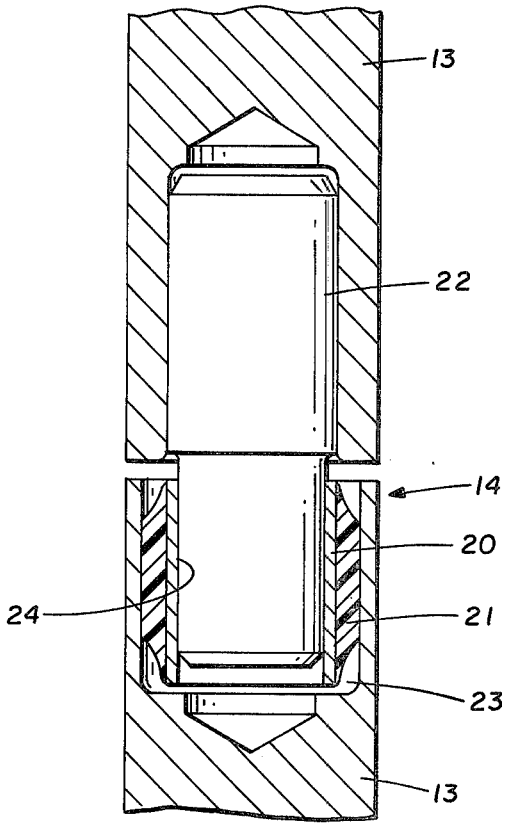
FIG. 6 is a fragmentary sectional view on an enlarged scale taken along lines 6—6 on FIG. 4, showing one embodiment of the flexible connection between the two arms.
Figure 4:
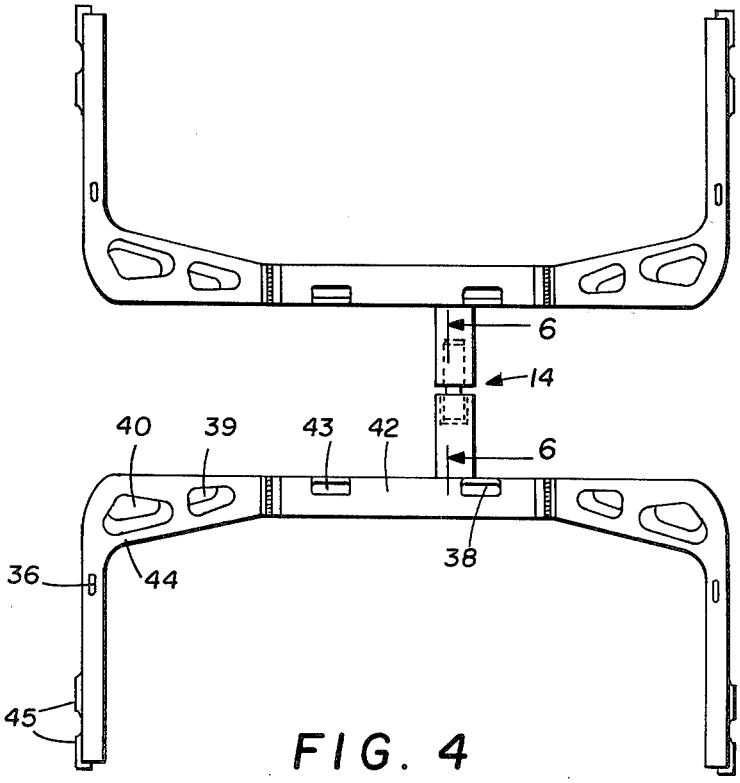
FIG. 4 is a top plan view of a mated pair of steering arms as related to the truck plan view of FIG. 1.
Figure 5:
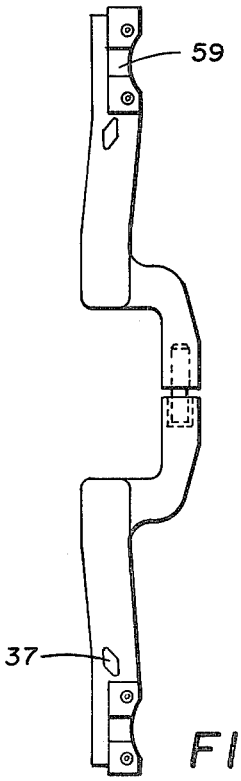
FIG. 5 is a side elevation view of a pair of mated steering arms as related to the truck side elevation FIG. 2.
Figure 7:
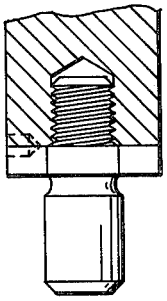
FIG. 7 is a fragmentary sectional view showing the male portion of the flexible connection of FIG. 6 secured by threaded means.
Figure 8:
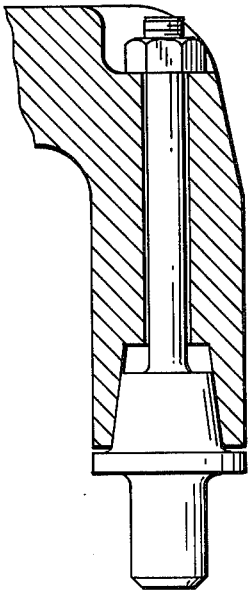
FIG. 8 is a fragmentary sectional view showing the male portion of the flexible connection of FIG. 6 secured by a locking taper and bolt means.

In accordance with the present invention, there is provided a railway car truck comprising at least a pair of longitudinally spaced wheelsets composed of axles with spaced apart wheels mounted thereon. Also, there are a pair of steering arm members, one for each axle, having means for rotative mounting on said axles. Each steering arm member extends from its axle to a point substantially midway between the axles when they are pivotally connected by pivotal connection posts on each arm member. A metal male member on one arm member slidably engages a recess in the other arm member with metal to metal contact. Means are provided to allow angling articulation of the arm members.

It is preferred that the connection posts of both arms are disposed in a plane below that of the arms.

Referring now in detail to the drawings in which like reference characters designate like parts, the truck 1 is a conventional railroad freight truck comprising side frames 2 and bolster 3 supported on wheelsets 4 utilizing roller bearing equipped journals 5 and equipped with standard brake beams 6 of the so-called "unit" type and converted to a radial truck by addition of the steering arms 7 and elastomeric pads 8 applied between journal bearing adapters 9 and the side frame pedestal jaw roof 10.

The steering arms 7 are comprised of a "U" shaped beam with two side arms 11, a cross beam 12, a connecting post 13 and a flexible connection 14. The outer extremities 15 of the steering arm 7 connect to the adapters 9 by high strength bolts 16 as shown. They could, however, be welded or cast integral if desired. The bolts 16 are applied through the adapters 9 and into taped holes in the side arms 11 or recessed nuts as required.

A pocket 59 is provided in the outer side of each side arm 11 midway between the adapter bolt holes and open at the bottom, proportioned to accept the retaining tabs 60 of the resilient adapter pad 8 with sufficient vertical clearance to permit the pad to be raised to clear the tabs 60 and then be withdrawn to the outside. This is to facilitate the removal of the adapter pad 8 without the need to remove the bolts 16 and separate the adapter 9 from the side arm 11.

The side arms 11 and the beam 12 are contoured to clear the side frames 2, the wheels 17, the bolster 3, the body center plate and side bearings (not shown), and the brake beam 6 under all conditions of wear, deflection, manufacturing tolerances and operation movement, and, to permit observation of and access to the brake head and shoe for maintenance purposes.

Likewise, the center connection post 13 is contoured or offset from the lateral centerline of the truck and downward from the beam 12 so as to pass with operating clearances through one brake rod hole 18 of the truck bolster 3. The other brake rod hole 19 can still be used to accommodate the brake rigging connection rod (not shown).

The flexible center connection 14 comprises an interconnecting pin 22 and resilient bushing 21 bonded to the walls of the recess 23, the male end bored to receive the pressed fit pin and the female end 23 is equipped with a hardened metal inner sleeve 24 to resist wear from the interaction of pin 22 during service operation.

Figure 12:
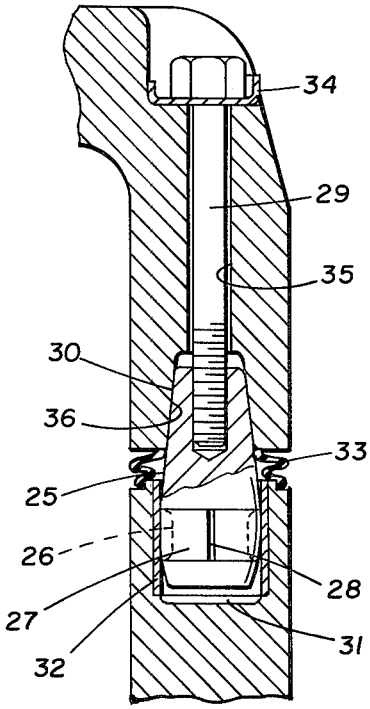
FIG. 12 is a fragmentary partially sectional view of another and preferred embodiment of the flexible connection between the two mated steering arms.
Figure 13:
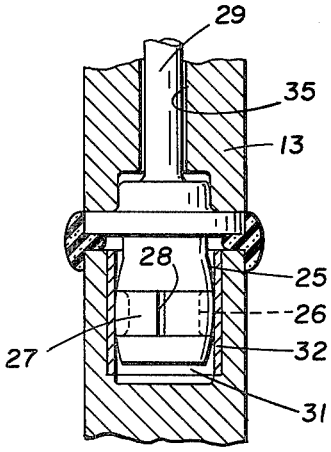
FIG. 13 is a fragmentary sectional view of another preferred embodiment of the flexible connection between the two mated steering arms with a different securement and seal than FIG. 12.

In the preferred center connection embodiments shown in FIGS. 12 and 13, the male pin 25 is barrel shaped to accommodate the relative angularity of the mated arms while assuming, with the wheelsets, the maximum radial position for curving, and provided with an annular groove 26 to receive a nylon or similar lubricious material sleeve 27 which is split through its section at 28 for application purposes.

The male piece 25 can be secured to the center connection post by bolt 29, locking means 34 and tapered shank 30 as shown, or by any other suitable means.

The female bore 31 is provided with a stainless steel bushing 32 which is very compatible with the nylon or similar sleeve 27 to give long service life with minimum wear.

To insure maximum wear properties, foreign matter is excluded from the wear surfaces of the connection by the application of a seal 33 designed to accommodate longitudinal movement between the two mated arms.

The opening 35 through the center connection post would be cored if the casting process is used and the taper 36 machined.

The steering arms are constructed throughout in hollow rectangular sections to develop the maximum strength for the space occupied. Certain openings are necessary, however, for core supports if made by the cast process such as at 36, 37, 38 and 39.

Openings are also required for functional purposes such as 40, for the access to and removal of the brake shoe key. The outer contour of the steering arm corner sections is thus designed to provide access but to also provide operating clearance. The inside surface 44 is sloped from top to bottom to match the wheel contour in order not to create a trap for foreign matter against wheel tread.

Also, the upper rear edge 42 is chamferred to clear the body center plate and the core holes 38 and 43 are located so as to clear the center plate bolts (not shown) during maximum truck rotation and maximum vertical deflection of springs 57.

The ends 15 of the side arms 11 are provided with pads 45 on the outer wall and are machined for fit up to the bolted adapter which has a machined inside face 46 for this purpose. Close tolerances are required to prevent undue lateral or skew loading of the roller bearings.

The correct functioning of the radial truck is dependent partially upon a prescribed lateral stiffness of the steering arm assembly and tests have proved that the construction of the present invention adequately provides that stiffness with the center flexible connection 14 as shown.

Use of the other embodiments of center flexible connection may require some adjustments to the lateral stiffness of the steering arms 7 which can readily be achieved by adjusting the structural section properties.

Figure 9:
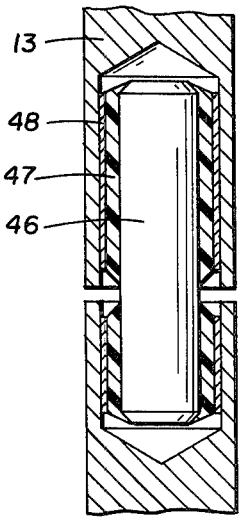
FIG. 9 is a fragmentary sectional view of another embodiment of the flexible connection between the two mated steering arms.

The embodiment of the center flexible connection shown in FIG. 9 comprises a pin 46 with a sleeve 47 of rubber bonded on each end and enclosed by bonded steel sleeves 48. Both center connection posts 13 are bored to accept the bushing and pin 46 in a sliding fit. This method eliminates the different boring procedures for the two mating center connection posts and the press fitting of the pin.

Figure 10:
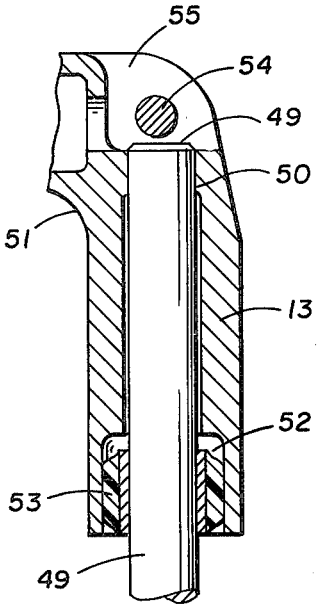
FIG. 10 is a fragmentary sectional view of another embodiment of the flexible connection between the two mated steering arms.

The embodiment of the center flexible connection shown in FIG. 10 comprises a long pin 49 capable of spanning the distance between bearing surfaces 50 at the bend 51 of the center connection post 13. Both post ends 52 are bored out to receive resilient bushings 53 to accommodate the necessary angularity.

Retaining means 54 are applied at each of the pins 49 in a pocket 55 cast at the connection post bend.

This construction will permit assembly of the steering arms with integral bearing adapters since the pin 50 can be applied after the arms are installed into the truck.

Figure 11:
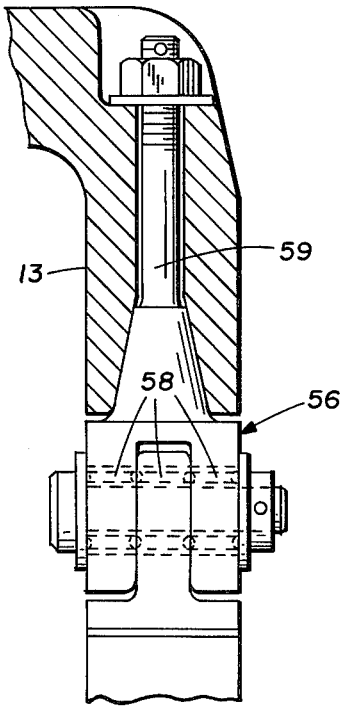
FIG. 11 is a fragmentary partially sectional view of another embodiment of the flexible connection between the two mated steering arms.

The embodiment of the center flexible connection shown in FIG. 11 comprises a clevis type connection 56 with a bolt and taper attachment 59 and with resilient bushings 58 in each leg of the clevis to provide the necessary flexibility in the directions other than lateral which is provided by the clevis.

This construction eases the assembly of the mating arms by providing a generous lead into engagement. The clevis itself would be assembled before installation.

From the above detailed description, it will be apparent that there has been provided a steering arm construction which can be retrofitted to a conventional truck, without detriment to the desirable features of the three-piece basic construction to convert it into a radially self-steered truck with the considerable advantages enumerated for this type of truck and proven by test.

It should be understood that the described and disclosed embodiments are merely exemplary of the invention and that all modifications are intended to be included that do not depart from the spirit of the invention and the appended claims.

The embodiments of the invention in which an exclusive property or privilege is claimed are defined as follows:

1. A railway car truck, including a standard bolster, having transverse openings for rod through brake rigging, resiliently supported on spring groups in side frames between spaced vertical columns thereof, a pair of longitudinally spaced wheelsets composed of axles with spaced apart wheels fixed thereon, the wheelsets being mounted on opposed ends of the side frames, a pair of "U" shaped steering arms respectively associated with the wheelsets and each having a cross beam and two side arms connected with its cross beam, each pair of side arms on each steering arm being mounted on the associated axle and being extended from its associated wheelset to a zone intermediate the axle, and each cross beam having a connecting post in the region of said zone, a first portion of which extends downwardly from the mid-region of the cross beam and a second portion of which extends longitudinally of the truck from a lower part of said first portion, the steering arms being contoured so that they remain clear of the side frames, wheels and bolster to permit access to the brake beam head and brake shoe and place said cross beams at a position clear of the brake beam and of the structure of the car and position the connecting posts in a position laterally of the truck to prevent interference with one of the standard bolster brake rod openings, while passing through another opening for interconnection with the mating steering arm, and the connecting posts having members slidably interengaging each other and angularly moveable with respect to each other to provide for angling articulation of the two steering arms and the associated wheelsets.

2. Truck of claim 1 in which a resilient seal is disposed between the interengaging members of said connecting posts.

3. Truck of claim 1 in which the connecting members are joined with a clevis type connection with a bolt passing therethrough.

4. Truck of claim 3 in which the bolt contains a resilient bushing around its outer periphery.

5. Truck of claim 1 wherein the connecting member of one post comprises a socket and the connecting member of the other post is barrel-shaped and positioned in the socket of the other member.

6. Truck of claim 5 in which the barrel shaped member has an annular groove and a sleeve, composed of lubricious material, is disposed in the groove.

7. Truck of claim 5 in which the recess in the socket has a resilient bushing bonded to its walls and a metal sleeve bonded to the bushing.

8. Truck of claim 5 in which the barrel-shaped member has successive sleeves of resilient material and metal material bonded to at least a portion of its outer periphery.

* * * * *